United States Patent [19]

Hite et al.

[11] Patent Number: 4,779,444

[45] Date of Patent: Oct. 25, 1988

[54] CLOSED DIE FORGING MACHINE

[75] Inventors: William H. Hite, Tiffin; Robert E. Loy, Bucyrus, both of Ohio

[73] Assignee: The National Machinery Company, Tiffin, Ohio

[21] Appl. No.: 24,812

[22] Filed: Mar. 12, 1987

[51] Int. Cl.[4] ..... B21D 22/00

[52] U.S. Cl. ..... 72/354; 72/357; 72/358

[58] Field of Search ..... 10/11 R, 11 E, 76 R; 72/344, 345, 346, 354, 357, 358, 359, 360, 453.02, 453.03

[56] References Cited

U.S. PATENT DOCUMENTS

| | | | |
|---|---|---|---|
| 1,026,082 | 5/1912 | Duston | 10/11 E |
| 1,874,158 | 8/1932 | Bausman et al. | 10/11 E |
| 4,148,209 | 4/1979 | Bessho | 72/441 |
| 4,321,818 | 3/1982 | Bessho | 72/453.02 |
| 4,466,266 | 8/1984 | Gardner et al. | 72/357 |

FOREIGN PATENT DOCUMENTS

| | | | |
|---|---|---|---|
| 523321 | 4/1954 | Belgium | 10/11 E |
| 266161 | 4/1950 | Switzerland | 72/359 |

*Primary Examiner*—E. Michael Combs

*Attorney, Agent, or Firm*—Pearne, Gordon, McCoy & Granger

[57] ABSTRACT

A closed die forging machine is disclosed in which the dies are clamped in their closed position by a hydraulically operated piston and cylinder means. A spacer is positioned between the clamping means and the movable die during the forging operation. Subsequent to the forging operation, the clamping means are released and the spacer is removed so that the movable die can be mechanically moved to its fully open position. By combining a removable spacer and hydraulic clamping means, it is possible to produce high die clamping forces without requiring substantial fluid flow to and from the clamping means. Therefore, pumping requirements are reduced and the tendency of the hydraulic fluid to become excessively hot is substantially reduced. Immediately after the completion of the forming operation within the closed die cavity, the hydraulic forces are released and a spring-powered system controlled by a cam-operated operator causes partial ejection of the finished workpiece from the stationary die. This minimizes the tendency of the fixed die to be excessively heated by the workpiece and improves die life. All of the operating functions, with the exception of the hydraulic clamping function, are mechanically produced and controlled. Consequently, high cyclic operating speeds can be achieved.

23 Claims, 6 Drawing Sheets

CLOSED DIE FORGING MACHINE

BACKGROUND OF THE INVENTION

This invention relates generally to forging machines, and more particularly to a novel and improved high-speed closed die forging machine.

PRIOR ART

Closed die forging machines are often hydraulically actuated to open and close the dies and to provide the forging forces. When hydraulic systems are utilized to open and close the dies, large pumping capacity is usually required, since the dies must move through a substantial distance between the closed position and the open position in which finished parts are removed and subsequent blanks are inserted for subsequent working. Generally in the past this has severely limited the operating speeds obtainable with such machines.

Further, because closed die forging machines often require high forces to hold the dies in the closed position, such hydraulically operated machines require high hydraulic pressure, and consequently require pumping systems capable of producing high pressure.

High flow volumes at high pressure, in addition to limiting the cyclic speed of such machines, also produce substantial heating of the hydraulic fluid and therefore require elaborate cooling equipment. In U.S. Pat. Nos. 4,148,209 and 4,321,818, combined machines are disclosed in which mechanical crank and pinion drive is incorporated into a hydraulically actuated, closed die forging machine. However, such machine still requires substantial fluid flow of high pressure fluid.

Still further, relatively low cyclic rates of such closed die machines cause the forging material to remain in contact with the dies for relatively long periods of time. This produces high die temperatures, particularly when warm or hot forging is involved. Such high die temperatures reduce die life.

SUMMARY OF THE INVENTION

In accordance with the present invention, a novel and improved closed die forging machine combines mechanical drives and hydraulic clamping. In such machine, high die clamping forces are hydraulically produced without high flow rates. Therefore, large pumping capacity is not required. Further, because low flow is required, the problem of heating of the hydraulic fluid is minimized.

In accordance with this invention, all of the operations of the machine other than the die clamping function are provided by mechanical drives. Therefore, high cyclic operating speeds are achieved. Still further improved die life is obtained, even when the machine is used for hot or warm forming. In the illustrated embodiment, the dies are opened slightly immediately after the completion of the forging operation. This reduces the time the hot workpieces are in intimely contact with the surface of the dies, and reduces the amount of die heating, with consequent increased die life.

In the illustrated embodiment, the dies are mechanically moved between the die-closed position and the die-open position. Once in the closed position, a spacer is positioned between the movable die and a hydraulic clamping mechanism. Such spacer is capable of transmitting the very high clamping forces required to hold the movable die in its fully closed position during the forging operation. Once the spacer is in position, the hydraulic clamping mechanism is pressurized and operates to apply a very high clamping force to the spacer, which in turn transmits such force to the movable die.

Because the spacer fills substantially the entire space between the movable die assembly and the hydraulic clamping mechanism, very little movement of the clamping mechanism is required. Therefore, very little fluid flow is required and the pumping capacity required for the operation of the clamping mechanism is not excessive.

After the forging operation is completed, the hydraulic pressure is released, and the spacer is mechanically removed. Once the spacer is removed, clearance is provided to allow the movable die to be mechanically moved to its fully open position. In such fully open position, the finished workpiece is removed and a subsequent blank is inserted between the dies for subsequent forming operations. The movable die is then mechanically moved to the closed position and the spacer is inserted so that the dies can be clamped closed by the hydraulic clamping mechanism.

Because the spacer is inserted and removed mechanically, its operation can be performed at high cyclic rates and high-speed machine operation is achieved. Because the hydraulic clamping system is not involved in the opening and closing of the dies, but only in applying a clamping force to the dies when the dies are closed, very low flow rates are required and the pumping capacity for the system is minimized. Further, because the amount of fluid displaced during a cycle of operation is relatively low, heating of the hydraulic fluid is not severe.

In the illustrated embodiment, the actual forging operations performed within the closed die cavity are powered by a crank and Pitman drive. Here again, the mechanical drive permits high speed operations when compared to the speeds of operation normally achieved in hydraulically actuated systems.

In accordance with another aspect of this invention, the dies are opened slightly immediately after the completion of the forging operation. Consequently, intimate contact is not maintained between the workpiece and the surfaces of the stationary die for an extended period of time. Therefore, the temperature of the fixed die is reduced even when warm or hot forging is being performed, and die life is improved.

These and other aspects of this invention are illustrated in the accompanying drawings, and more fully described in the following specification.

DETAILED DESCRIPTION OF THE DRAWINGS

Figure 1:
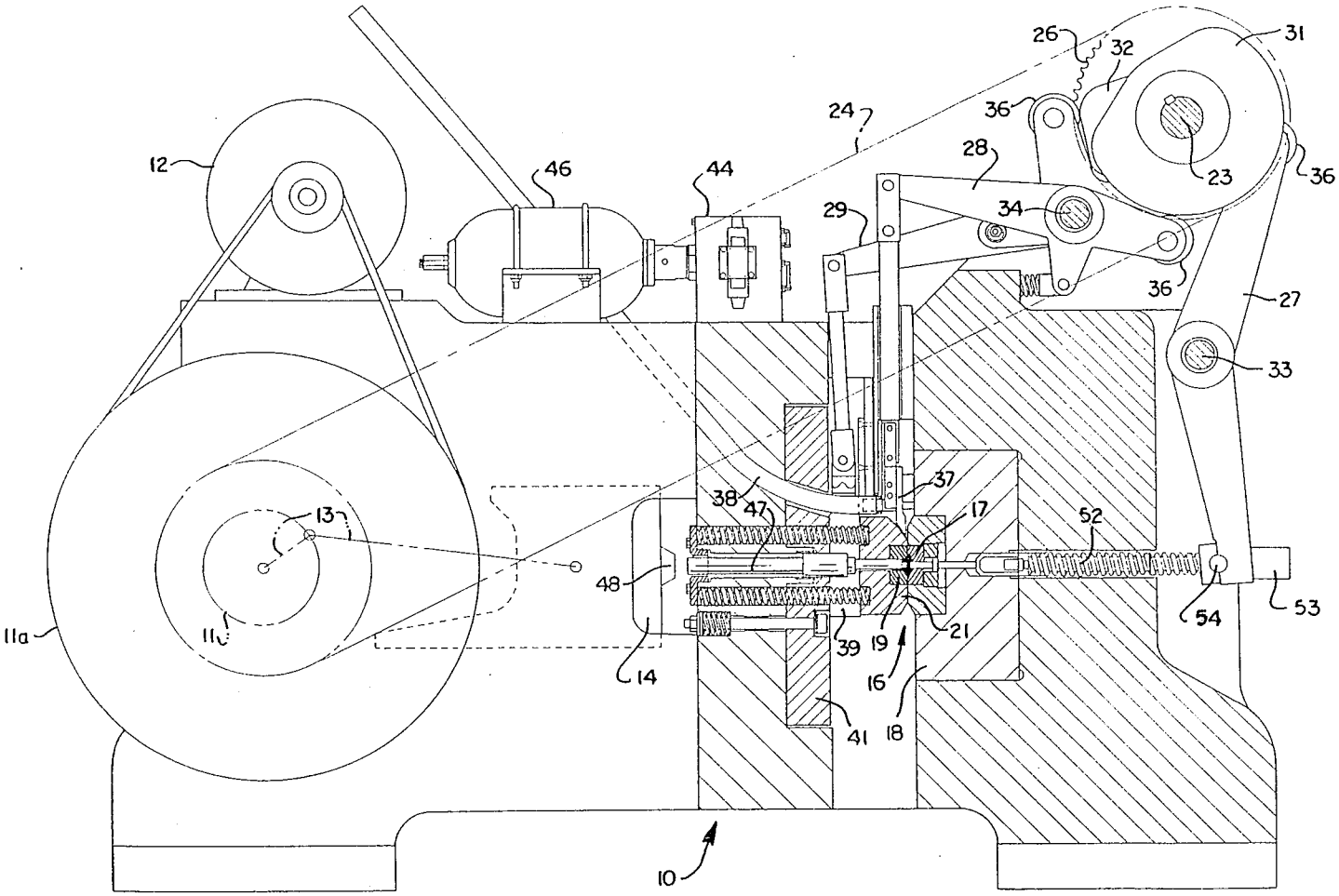
FIG. 1 is a schematic side elevation, partially in longitudinal section, of a closed die forging machine incorporating this invention.

FIG. 1 illustrates an overall machine incorporating the present invention. Such machine provides a main frame 10. Mounted on one end of the frame is a crankshaft 11 driven by a motor 12. A flywheel 11*a* is mounted on one end of the crankshaft. A crank and Pitman drive schematically illustrated at 13 connects the flywheel 11*a* to a reciprocating slide 14. The slide is supported for reciprocating movement in frame-supported bearings (not illustrated) and is movable by the crank and Pitman drive 13 between a forward dead center position and a retracted or rearward dead center position.

Figure 2:
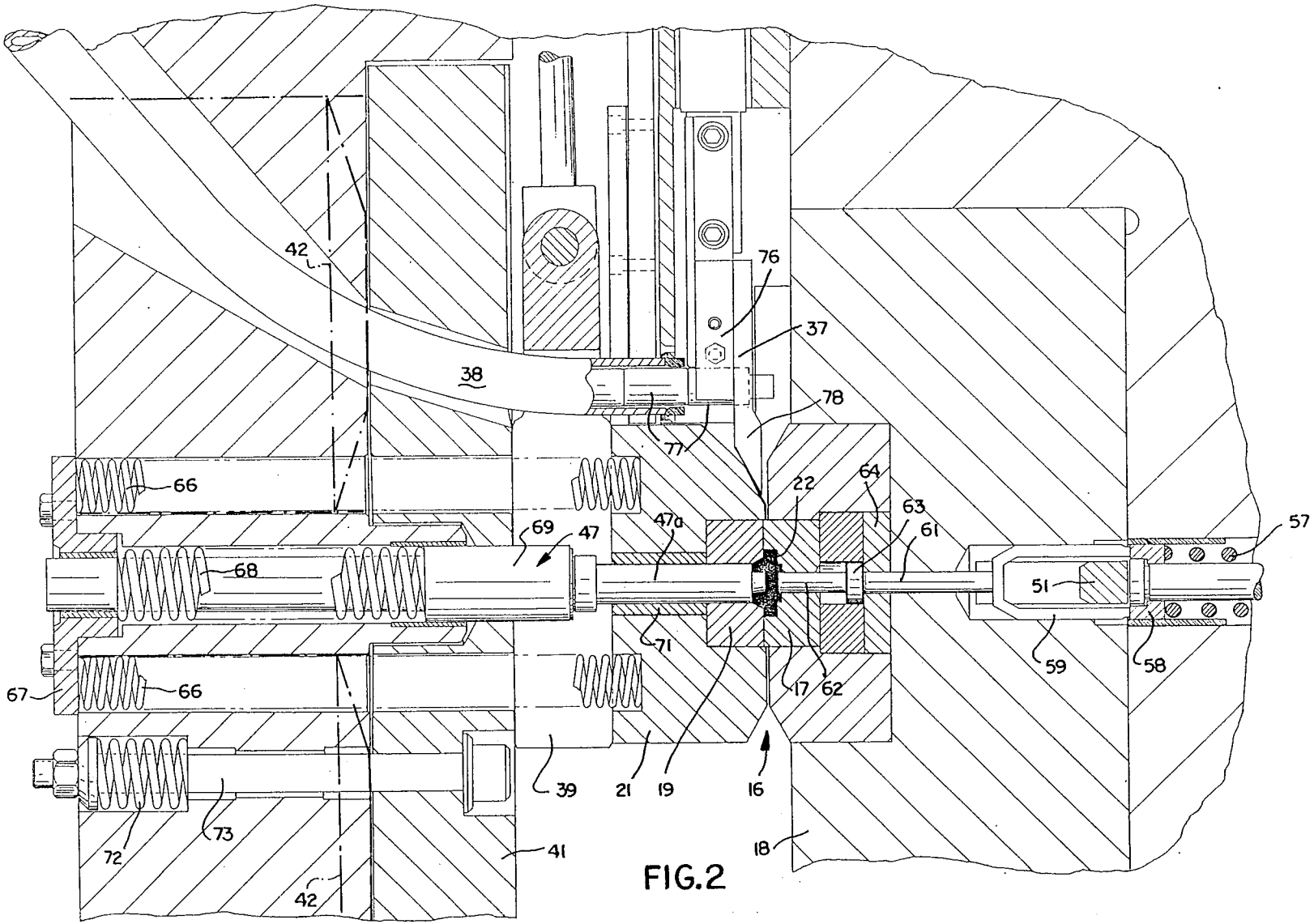
FIG. 2 is an enlarged, fragmentary vertical section, taken along the centerline of the working station.
Figure 3:
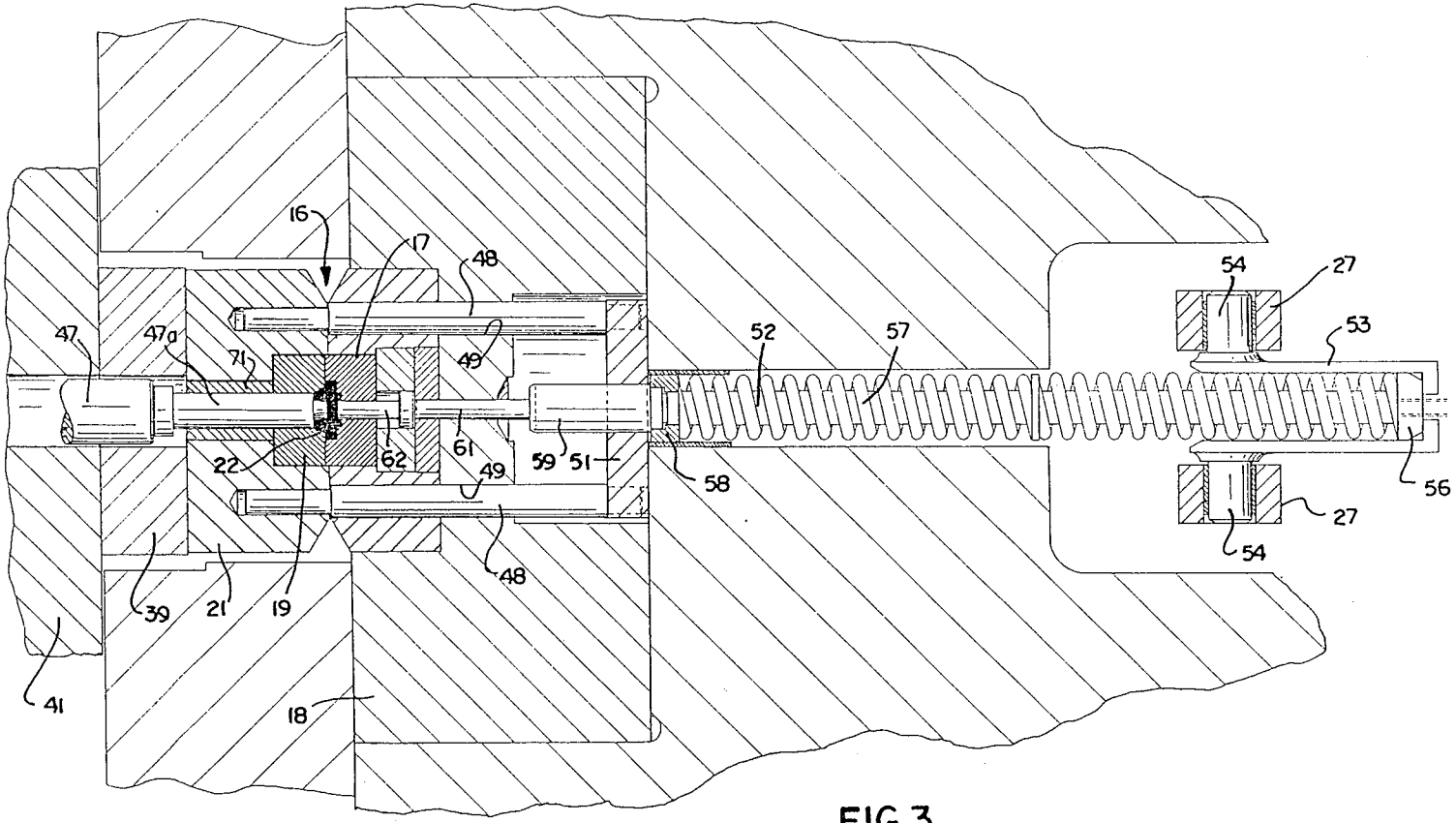
FIG. 3 is an enlarged, fragmentary, horizontal section, taken along the centerline of the working station.

A work station 16 is provided by a fixed die 17 supported within a die breast 18 and a movable die 19 supported in a movable die support block 21. In FIGS. 1 through 3, the movable die 19 is illustrated in its forward or closed position in engagement with the fixed die 17. The two dies cooperate to define a closed die cavity 22 when the movable die is in the illustrated forward or closed position.

A camshaft 23 is journaled on the machine frame 10 and is driven in timed relation to the rotation of the crankshaft 11 by a drive chain 24 and a sprocket wheel 26 mounted on the camshaft. Mounted on the camshaft 23 are three separate cams which respectively operate a kickout lever 27, a transfer operating lever 28, and a spacer block operating lever 29. In FIG. 1, only two of the cams appear, namely, the transfer lever operating cam 31 and the spacer block operating cam 32. The third cam, which operates the kickout lever 27, does not appear in FIG. 1 because it is hidden by the other two cams 31 and 32.

The kickout lever 27 is pivoted on the machine frame 10 by a pivot shaft 33 and the two levers 28 and 29 are journaled on the machine frame by a pivot shaft 34. Each of the levers 27, 28, and 29 is provided with a cam follower 36 which engages the associated cam so that rotation of the camshaft causes oscillating pivotal movement of the various levers in timed relationship to the operation of the machine.

The kickout lever 27 provides a number of functions, including the ejection of the workpiece from the dies, and movement of the movable die between its open and closed positions. This operation is discussed in greater detail below. The transfer lever 28 is connected to reciprocate the workpiece transfer mechanism 37 between the position in which it receives a workpiece from the workpiece supply tube 38 and an extended position in which it positions the workpiece between the dies. The spacer block operating lever 29 is connected to retract and extend the spacer block 39.

Figure 5:
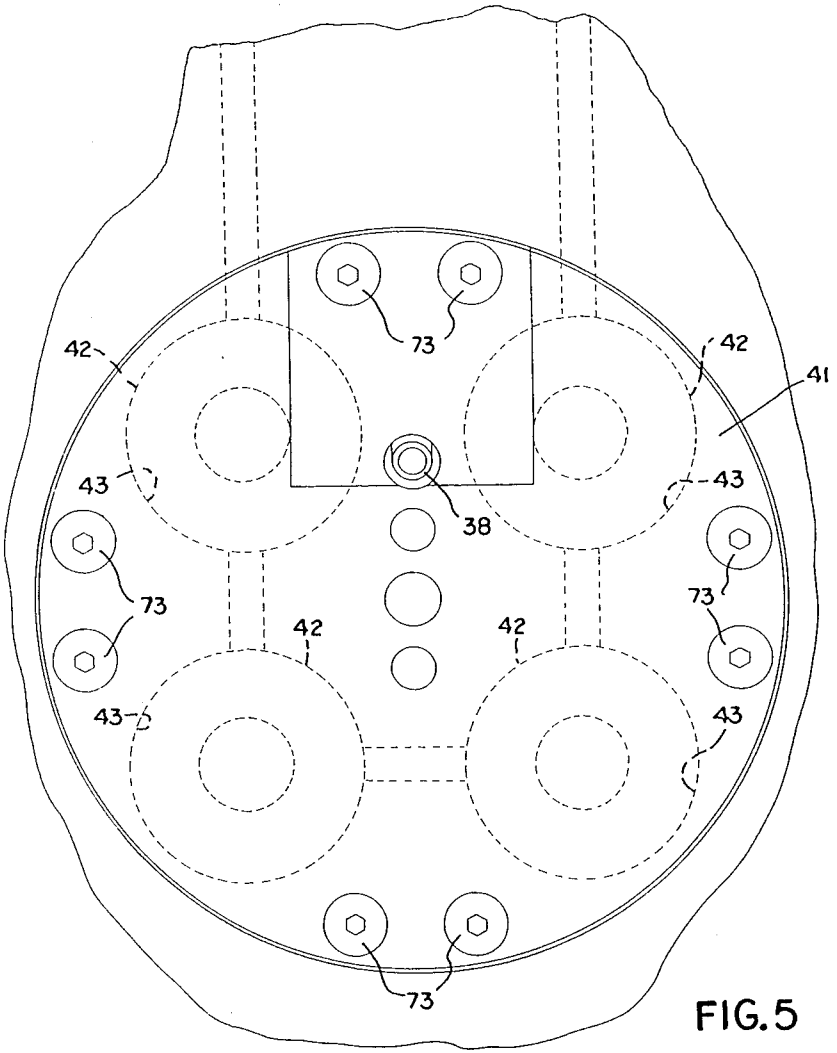
FIG. 5 is a fragmentary section, illustrating the pressure plate and the arrangement of the hydraulically operated clamping pistons.

Positioned on the side of the spacer block 39 opposite the movable die support 21 is a pressure plate 41. Located on the side of the pressure plate 41 remote from the spacer block 39 are four pistons 42 (illustrated in phantom in FIG. 2) symmetrically arranged around the central axis of the work station 16. These pistons are positioned along 45-degree diagonals, as best illustrated in FIG. 5; therefore, they are not contained within the vertical section of FIG. 1. The pistons are located within cylinders 43 formed in frame 10. Hydraulic fluid under pressure is supplied to an accumulator 46 by a small, remote pump (not illustrated), and is, in turn, supplied to the cylinders 43 during forging operations through a control valve 44. This results in a large, hydraulically produced force which is transmitted by the pistons 42 through the pressure plate 41 and the spacer plate 39 to the movable die support 21 to hold the dies in the closed position during the actual forming operations performed. The actual forming of the workpiece is performed by a punch operator 47 which extends at its forward end to a punch 47*a* which extends into the movable die 19 and is engaged at its rearward end by a nose 48 on the slide 14 as the slide approaches its forward dead center position. The action of the punch is to upset the workpiece within the closed die cavity 22 and cause it to assume the shape of such die cavity.

Reference should now be made to FIGS. 2 and 3, which illustrate the structure of the operating mechanism in greater detail and at larger scale. In such figures, the dies are illustrated in the closed position, with the punch assembly 47 in the forward dead center position at the completion of the forming operation. In such closed position, the fixed die 17 projects a small distance into the die cavity in the movable die support 21 and ensures exact alignment between the two dies 17 and 19.

The movable die support 21 is mounted on a pair of slide pins 48, which extend through and are guided by bores 49 in the die breast 18. These pins extend into the forward face of the movable die support 21 and function to support the movable die 19 as it moves back and forth between its open and closed position and also provides the structure for causing the movable die to move to its opened position. The rearward ends of the slide pins 48 are press-fitted into the ends of a crossbar 51 which is engaged on its rearward side by the forward end of an operating rod 52. Such rod extends rearwardly of the machine to a yoke 53 pivotally connected on each side of the operating rod by pivots 54 to the lower end of the kickout lever 27. The rearward end of the operating rod is threaded to receive an adjusting nut 56. When the lower end of the kickout lever 27 moves to the left, as viewed in FIG. 3, the yoke 53, through its engagement with the adjusting nut 56, causes the operating rod 52 to move to the left, as viewed in that Figure. This, in turn, operates to move the movable die 19 toward its open position when the spacer block 39 is retracted clear of the movable die support 21, as discussed in detail below.

Positioned around the operating rod 52 is a compression spring 57 which engages the adjusting nut 56 at its rearward end and a collar 58 at its forward end. The forward end of the collar 58 engages the rearward ends of a fork 59, best illustrated in FIG. 2, which is slidably mounted in the die breast 18. The fork 59 is provided with a rod 61 which extends forwardly and engages the rearward end of a kickout or ejection pin 62. The kickout pin 62 is slidably mounted in the fixed die 17, and is provided with a head 63 which seats against a spacer 64. During the actual forging operation, the forward end of the kickout pin 62 forms a portion of the die cavity 22 and forging loads applied to such forward end are transmitted through the spacer 64 to the die breast 18 so that such forging loads are not transmitted back through the fork 59. However, sufficient force is transmitted through such fork to slide the collar 58 back against the resilient force of the spring 57 a small amount. The purpose of this movement is discussed in greater detail below.

A pair of compression springs 66 extend between a mounting plate 67 at their rearward end and the movable die support 21 at their forward end. These springs resiliently bias the movable die 19 toward its closed position. Further, a centrally located compression spring 68 extends between the mounting plate 67 and a shoulder 69 on the punch operator 47 and resiliently urges such operator in a forward direction toward the die face. The forward end of the punch operator 47 engages the rearward end of the working punch 47*a*, which is slidably mounted in a bearing 71 carried by the movable die support 21.

A set of eight compression springs 72 symmetrically positioned around the pressure plate 41 acts through bolts 73 to urge the pressure plate 41 to the left as viewed in FIGS. 1 and 2 in a retracting direction. In FIGS. 1 and 2, one of the compression springs 72 and bolt 73 is moved out of its true position into the plane of the sections of FIGS. 1 and 2 for purposes of illustration. However, these springs and bolts are located in pairs around the periphery of the pressure plate 41, as illustrated in FIG. 5. The springs 72 and bolts 73 operate to retract the pressure plate to a rearward position when pressure is released from the cylinders 43 and to allow forward or extending movement of the pressure plate for clamping the dies in the closed position when hydraulic fluid under pressure is supplied to such cylinders.

Figure 4:
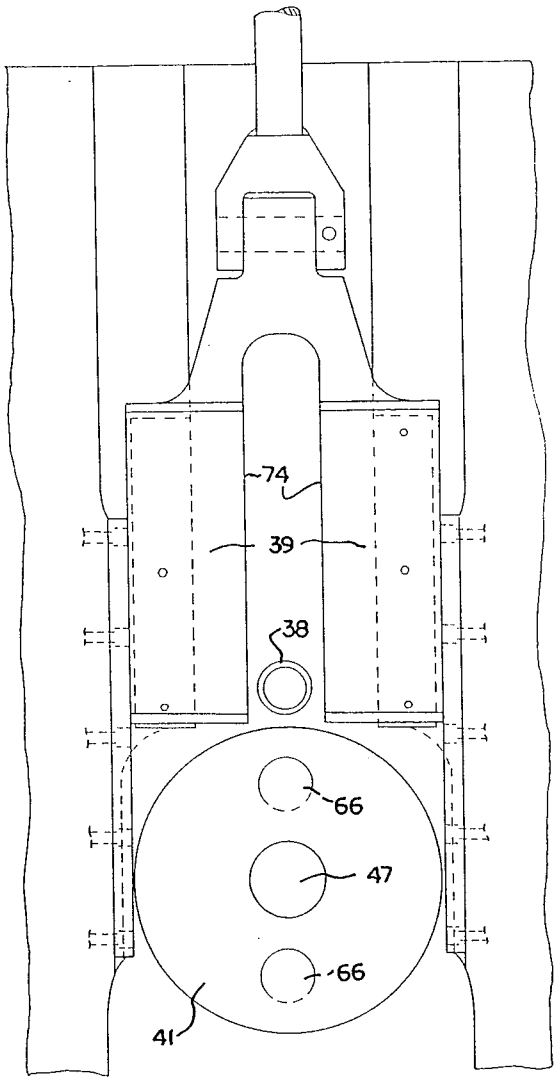
FIG. 4 is a fragmentary section, illustrating the structure of the spacer block in the retracted position.

The spacer block 39 is shaped as illustrated in FIG. 4, and is provided with a central cutout 74 so that the spacer block can be dropped down alongside the workpiece supply tube 38, the compression spring 66, and the punch operator 47 without interference. Such spacer block, however, provides support for the transmission of the clamping force from the pressure plate to the movable die support 21 on both sides of the axis of the dies.

The transfer 37, as best illustrated in FIG. 2, is provided with a pair of opposed gripper fingers 76 shaped at their lower ends to receive and grip workpieces 77. A camming system (not illustrated) is provided to spread the gripper fingers slightly when the transfer is fully raised to its workpiece pickup position illustrated in FIG. 2. In such position, gravity feeds workpieces 77 down along the workpiece supply tube 38 and into the raised gripper fingers. When the movable die is retracted or moved to its open position, the transfer then carries a workpiece down into the die area, where it is subsequently gripped, as described below, and is subsequently upset to the shape of the die cavity 22. Also mounted on the transfer mechanism 37 is a plow-shaped element 78 which engages the finished workpiece and ensures that such workpiece is removed from the die area.

Figure 6A:
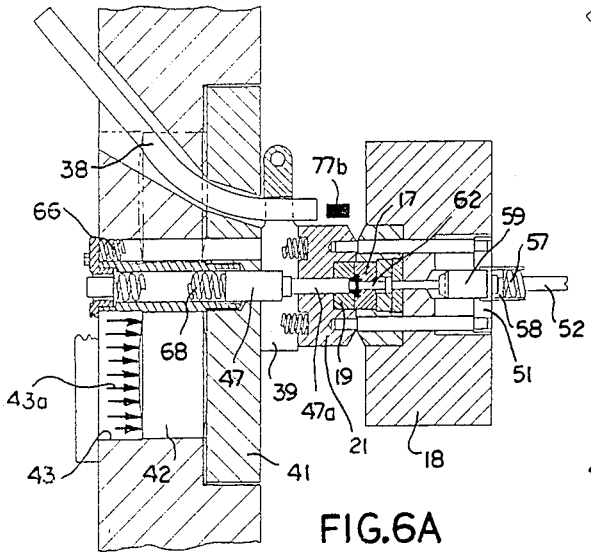
FIGS. 6*a* through 6*h* are schematic sections progressively illustrating the operation of the machine through one full cycle of operation.
Figure 6B:
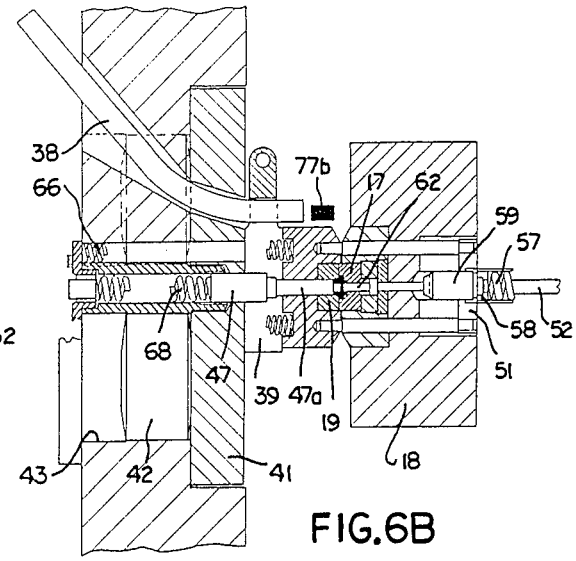

The sequence of operations of the machine is best illustrated in FIGS. 6*a* through 6*h*. FIG. 6*a* illustrates the condition which exists when the slide has reached the forward dead center position and completed the forging operation. In the drawings, the workpiece is illustrated in solid black in order to provide a clear illustration of its position and its shape. In FIGS. 6*a* through 6*h*, the transfer has been eliminated for purposes of illustration, and one of the pistons 42 has been moved out of its true position so as to provide a better illustration of the operation of the machine. Further, certain of the structural elements are not illustrated, again to provide a better illustration of the operation of the machine.

FIG. 6*a* illustrates the position of the various elements at the completion of the forging operation, in which the slide is at the forward dead center position, causing the punch 47*a* to be extended fully into the die cavity. At this point in the machine cycle, hydraulic pressure has been applied to the cylinders 43 and a die clamping force produced by the pistons 42 is transmitted through the pressure plate 41 and the spacer block 39 to the movable die support 21. The fact that pressure is present in the cylinders is indicated by the arrows 43*a*. For example, such clamping force may be in the order of 700,000 pounds. Therefore, the dies are held closed with sufficient force to overcome any forging-induced forces tending to produce separation between the dies and a very accurately shaped part is produced.

The forging force is transmitted to the kickout pin 62, which causes it to bottom-out; however, before the actual bottoming-out occurs, such forces act through the fork 59 to move the collar 58 against the action of the spring 59 back along the operating rod 52 a small distance, usually in the order of 1/32 inch. At this point in the cycle, the subsequent workpiece 77 has moved down the workpiece supply tube 38 and is positioned within the transfer grippers (not illustrated in FIGS. 6*a* through 6*h*).

As soon as the slide 14 passes its forward dead center position and commences to retract, the hydraulic pressure is exhausted from the cylinders 43. This is the condition existing in FIG. 6*b*. This allows the pressure plate retracting springs 73 (illustrated in FIG. 2) to retract the pressure plate 41 a small distance and allows the spring 58 to move the fork 59, and in turn the kickout pin 62, in a forward direction about 1/32 inch to lift the finished workpiece away from the fixed die 17 a small amount. The force of the spring 57 is selected to be greater than the combined forces of the springs 66 so that this action can occur. The clearances provided in the pressure plate 41 and the spacer block 39 are selected to allow this slight movement. Because the finished workpiece is lifted away from the fixed die 17 a small amount, virtually immediately after the forging operation is completed, the heat transfer from the hot workpiece to the fixed die 17 is minimized and the temperature of the fixed die does not become excessive. Therefore, improved die life is achieved. This is particularly important when warm or hot forging operations are being performed.

The amount of extension of the collar 58 by the spring 57 is limited, however, by the engagement of the collar on the head of the operating rod 52 so that the movable die does not continue to maintain clamping contact against the spacer block 39. Therefore, the spacer block 39 can be freely lifted up from its locking position of FIG. 6*b* to the retracted position illustrated in FIG. 6*c*. The adjusting nut 56 illustrated in FIG. 3 permits precise adjustment of the amount of movement of the movable die support 21 caused by the spring 57 to ensure that the slight retraction of the pressure plate 41 releases the forces on the spacer block to allow its easy removal. It should be noted, however, that the stroke of the pistons is very small; consequently, the amount of flow of hydraulic fluid required between the extended piston position and the exhausted piston position is low.

Figure 6C:
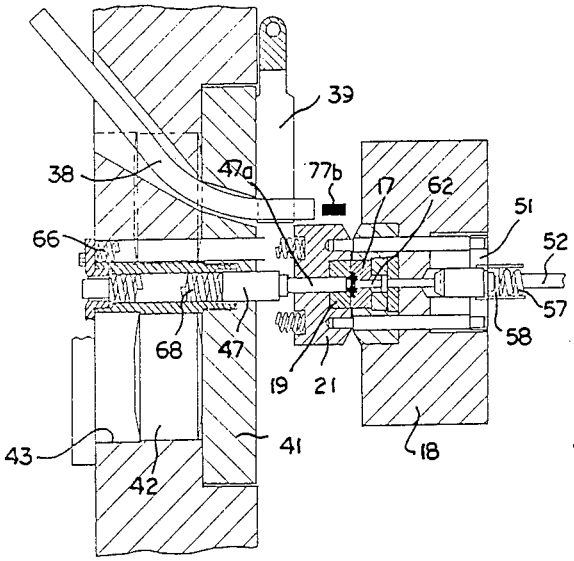
Figure 6D:
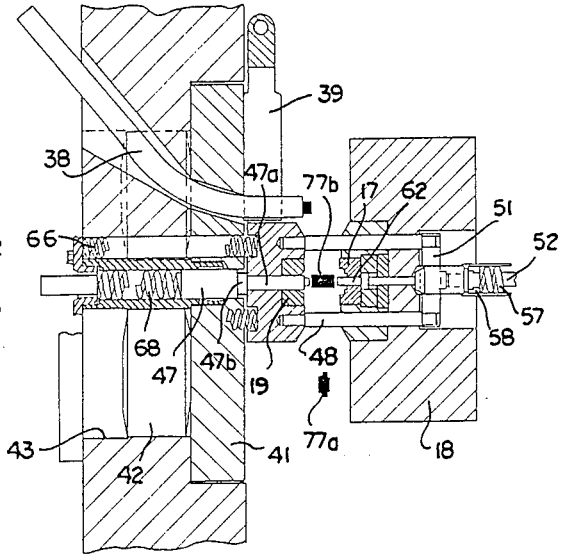
Figure 6E:
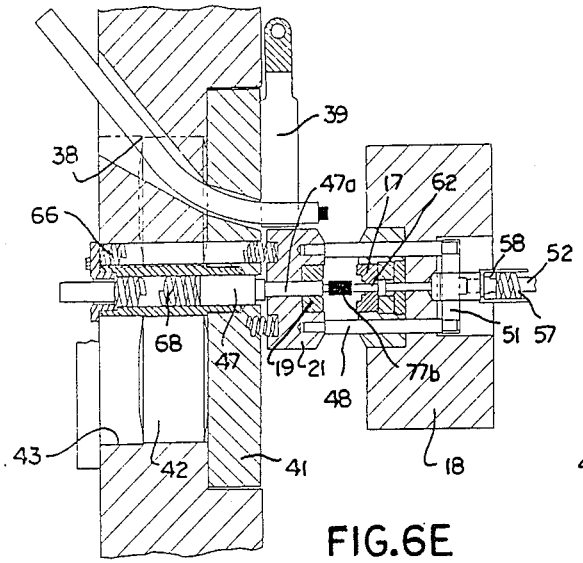

As soon as the spacer block 39 is raised clear of the movable die support 21, the movable die support can be moved through a substantial distance to its fully open position of FIG. 6*d*. Such movement is caused by extension of the operating rod 52 caused by the kickout lever 27, illustrated in FIG. 1. Extension of the operating rod 52 acts through the crossbar 51 to push the slide pins 48 forward against the action of the springs 66 and moves the movable die to the fully open position. It should be noted that the travel of the movable die between the substantially closed position of FIG. 6*c* and FIG. 6*d* is substantially greater than the amount of movement of the pistons 42. Such forward movement of the operating rod 52 allows the spring 57 to move the collar 58 and the fork forward, to cause the kickout pin 62 to eject the finished workpiece 77*a* from the dies. Further, the action of the spring 68 causes the punch 47*a* to move forward a small amount with respect to the movable die support to ensure that the finished workpiece is ejected from the movable die 19. The movement of the punch with respect to the movable die is limited by engagement of the head 47*b* with the movable die support 21.

As the movable die moves toward its fully open position of FIG. 6*d*, the transfer extends downward between the dies, causing the plow-shaped element 78 (illustrated in FIG. 2) to engage the finished workpiece 77*a* in the event it remains on the kickout pin 62 to assure that the finished workpiece is cleared from the die area. Simultaneously, the transfer moves a subsequent workpiece 77*b* down into alignment with the dies. This is the condition existing as illustrated in FIG. 6*d*.

As soon as the subsequent workpiece 77*b* is properly positioned at the centerline of the work station, the operating rod 52 retracts a small amount, allowing the springs 66 to move the movable die support forward a small distance. This allows the punch 47*a* to also move forward into engagement with the end of the subsequent workpiece 77*b*. During the extension of the operating rod 52, the kickout pin 62 bottoms out, thereby limiting the forward movement of the fork 59 with the rod 52, and causes the collar 58 to compress the spring 57. Therefore, as the operating rod 52 commences to retract, the spring 57 holds the kickout pin 62 forward so that the forward movement of the movable die support 21 and the punch 47*a* causes the subsequent workpiece 77*b* to be gripped between the punch 47*a* and the kickout pin 62. This is the condition illustrated in FIG. 6*e*. Since the subsequent workpiece 77*b* is supported, the transfer can then retract clear of the dies.

Figure 6F:
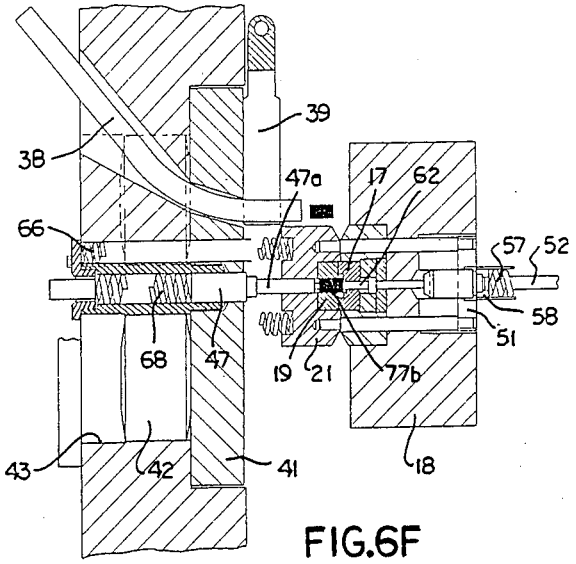
Figure 6G:
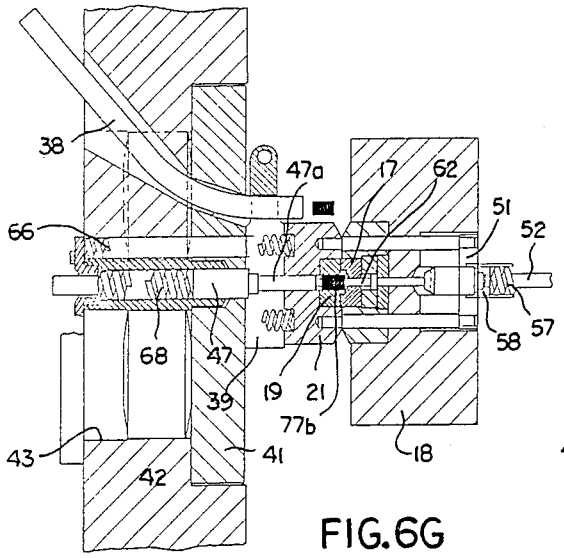

Once the transfer is clear of the dies, the further retraction of the operating rod 52 allows the movable die support to be moved by the springs 66 to the closed position illustrated in FIG. 6*f*. Here again, the substantial movement of the movable die support 21 to the fully closed position is mechanically controlled by the movement of the operating rod 52.

Figure 6H:
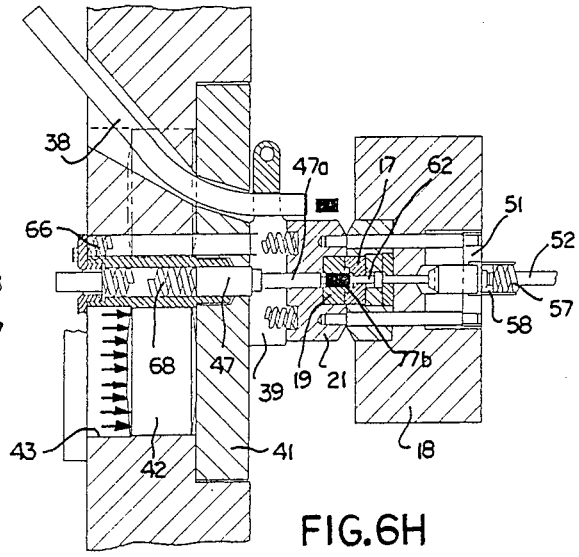

As soon as the movable die is moved to its closed position illustrated in FIG. 6*f*, the spacer block 39 is lowered to its operative position between the rearward side of the movable die support 21 and the pressure plate 41. This is the operative position illustrated in FIG. 6*g*. At the completion of the extension of the spacer block 39, the cylinders 43 are again pressurized to move the pistons 42 forward through a small distance so that a clamping force is transmitted through the pressure plate 41 and the spacer block 39, clamping the dies closed with a very high force preparatory to the next forging operation. This is the condition existing as illustrated in FIG. 6*h*. The forward movement of the slide 14 then causes the punch 47*a* to extend and upset the subsequent blank in the die cavity, returning the various operating elements to the position illustrated in FIG. 6*a* and completing one full cycle of operation.

Because the stroke of the pistons 42 is very small, the amount of hydraulic fluid under pressure required to produce the clamping force is minimized. Therefore, the capacity of the pump need not be large. Further, the power consumption required to clamp and release the dies is minimized. Still further, the heating of the hydraulic fluid due to the pumping action is also minimized. This eliminates the need for large cooling equipment for the hydraulic fluid. Further, this structure, in which the amount of fluid flow for clamping is very small, allows the cyclic speed of the machine to be increased drastically.

All of the various functions, with the exception of the die clamping, which is performed hydraulically, are mechanically actuated. Therefore, high cyclic speeds and high output can be achieved. For example, a machine incorporating this invention can operate at between 60 and 100 cycles per minute. In effect, a machine according to the present invention incorporates the best features of both mechanical and hydraulically operated systems.

Further, the opening and closing of the dies, as well as the ejection of the finished workpiece and the gripping of the subsequent workpiece, are controlled entirely by the kickout lever through the action of the operating rod 52 and spring 57. By combining the control of a large number of functions in a single operating rod, the mechanism of the machine is substantially simplified. Further, the use of simple compression springs, which are very reliable in operation and are not subject to fatigue failures and the like, allows various elements of the system to be actuated with a simple single operating rod drive, even at high operating speeds. Consequently, maintenance problems are minimized and reliable high-speed operation is achieved.

Although the preferred embodiment of this invention has been shown and described, it should be understood that various modifications and rearrangements of the parts may be resorted to without departing from the scope of the invention as disclosed and claimed herein.

What is claimed is:

1. A closed die forging machine comprising a pair of dies movable relative to each other between a closed position in which they cooperate to define a closed die cavity and an open position in which finished workpieces are removed and unworked workpieces are positioned between said dies, mechanical power means connected to open and close said dies and to upset unworked workpieces within said die cavity, and fluid pressure-operated clamping means operable after said dies are closed to clamp said dies in said closed position with sufficient force to overcome forming forces tending to separate said dies, said fluid pressure-operated clamping means including a pressure clamping element movable between a clamping position and a release position, said clamping element moving between said clamping position and said release position through a distance substantially less than the distance of movement of said dies between said closed position and said open position.

2. A closed die forging machine as set forth in claim 1, wherein at least one of said dies moves through a substantial distance between its closed position and its open position, and spacer means are movable between a locking position and a release position, said spacer means preventing movement of said one die from its closed position when said spacer means is in said locked position and allowing movement of said one die to its open position when said spacer means is in said release position.

3. A closed die forging machine as set forth in claim 2, wherein said one die is a movable die and the other of said dies is a fixed die.

4. A closed die forging machine as set forth in claim 3, wherein said spacer means is a spacer block positioned between said movable die and said clamping means when said spacer means is in said locked position, said spacer block operating to transmit said clamping force from said clamping means to said movable die.

5. A closed die forging machine as set forth in claim 4, wherein said clamping element is provided at least in part by piston means mounted for movement in cylinder means.

6. A closed die forging machine as set forth in claim 5, wherein said piston means includes a plurality of pistons symmetrically positioned around said dies.

7. A closed die forging machine as set forth in claim 4, wherein said mechanical power means includes a tool movable into said die cavity to upset a workpiece, and a crank and pitman drive for said tool.

8. A closed die forging machine as set forth in claim 1, wherein said clamping means is released after a workpiece is upset, and release means are provided to move an upset workpiece away from at least one of said dies before said dies open to limit heat transfer from said workpiece to said one of said dies.

9. A closed die forging machine as set forth in claim 8, wherein a spacer is positioned between said clamping means and said dies when said workpiece is upset, and sufficient clearance is provided to permit said movement by said release means when said clamping means is released.

10. A closed die forging machine as set forth in claim 9, wherein said fluid pressure-operated clamping means are operated by hydraulic fluid.

11. A closed die forging machine comprising a frame, a fixed die in said frame and a movable die movable between a closed position engaging said fixed die and an open position spaced from said fixed die, said dies when closed cooperating to define a die cavity, mechanical power means connected to said movable die operable to cause movement thereof between said open and closed position, spacer means movable between a locked position and a release position, and hydraulic force means operable to produce a force transmittable through said spacer means to hold said movable die in said closed position when said spacermeans is in said locked position, operating of said spacer means to said release position permitting said movable die to move to said open position without stroking said hydraulic force means, and forging means operable to cause flow of material into said die cavity while said movable die is held closed by said hydraulic force means.

12. A closed die forging machine as set forth in claim 11, wherein said hydraulic force means includes a plurality of pistons symmetrically positioned around said dies operable to press against a pressure plate which in turn presses against said spacer means to clamp said dies in said closed position.

13. A closed die forging machine as set forth in claim 11, wherein said mechanical power means includes an extendable and retractable operator operable when extended to move said movable die to an open position, and first spring means are provided to move said movable die to said closed position when said operator retracts.

14. A closed die forging machine as set forth in claim 13, wherein an ejector is provided to eject finished workpieces from said fixed die, and second spring means bias said ejector in a direction tending to cause said ejector to eject finished workpieces from said fixed die.

15. A closed die forging machine as set forth in claim 14, wherein said second spring means exerts a greater force than said first spring means and partially ejects a finished workpiece when said hydraulic clamping means are released.

16. A closed die forging machine as set forth in claim 15, wherein said second spring means are mounted on said operator, and said operator limits extension of said ejector by said second spring means when said hydraulic clamping means are released.

17. A closed die forging machine comprising a fixed die, a movable die movable between a closed position in which said dies cooperate to define a closed die cavity and an open position in which finished workpieces are removed and unworked workpieces are positioned for working in said die cavity, an ejector projecting into said fixed die for ejecting finished workpieces therefrom, a tool projecting into said movable die for upsetting workpieces within said die cavity, an operator connected to said movable die for moving said movable die between said open and closed positions, a reciprocating slide operable to move said tool toward said die cavity to cause said upsetting of workpieces in said die cavity, an ejector spring urging said ejector in an ejection direction, and clamping means preventing movement of said movable die from said closed position while said tool upsets a workpiece, said clamping means releasing said movable die after a workpiece is upset in said cavity, said ejector spring moving said ejector to at least partially move said movable die from its fully closed position and to eject said workpiece from said fixed die when said clamping means are released.

18. A closed die forging machine as set forth in claim 17, wherein die closing spring means are provided to urge said movable die toward its closed position, and said ejector spring produces a greater force than said closing spring means and moves said movable die toward its open position when said clamping means are released.

19. A closed die forging machine as set forth in claim 18, wherein tool spring means operate to urge said tool in a direction toward said fixed die, said tool spring means and ejector spring means causing an unworked workpiece to be gripped and positioned between said dies by said ejector and tool as said dies close.

20. A closed die forging machine as set forth in claim 19, wherein a transfer is provided to position an unworked workpiece between said tool and ejector while said dies are open.

21. A closed die forging machine as set forth in claim 20, wherein the timing of opening and closing dies and the operation of said ejector are controlled by said operator.

22. A closed die forging machine as set forth in claim 17, wherein a spacer is positioned between said clamping means and said movable dies during the upsetting of a workpiece in said die cavity, said spacer reducing the required stroke of said clamping means.

23. A closed die forging machine as set forth in claim 22, wherein said clamping means is operated by fluid under pressure.

* * * * *